US005485929A

United States Patent [19]

Danon

[11] Patent Number: 5,485,929

[45] Date of Patent: Jan. 23, 1996

[54] POINT OF PURCHASE DISPENSER

[76] Inventor: Joseph Danon, 580 Mountain Ave., North Caldwell, N.J. 07006

[21] Appl. No.: 322,696

[22] Filed: Oct. 13, 1994

[51] Int. Cl.[6] ..... B42F 13/00

[52] U.S. Cl. ..... 211/57.1; 211/59.1; 211/45; 248/309.2; 248/316.1; 248/220.42

[58] Field of Search ..... 211/57.1, 59.1, 211/89; 248/220.3, 220.4, 221.1, 221.2, 316.1, 309.2, 414, 683, 221.3

[56] References Cited

U.S. PATENT DOCUMENTS

| | | | |
|---|---|---|---|
| 3,534,864 | 10/1970 | Larson | 248/220.4 |
| 4,085,848 | 4/1978 | Tsuge | 211/89 |
| 4,474,300 | 10/1984 | Entis | 211/59.1 |
| 4,778,487 | 10/1988 | Chenel | 248/221.3 |
| 5,009,334 | 4/1991 | Bodkins | 211/57.1 |
| 5,144,021 | 5/1992 | Fredrickson | 211/59.1 |
| 5,144,345 | 9/1992 | Nyman | 211/59.1 |

*Primary Examiner*—Leslie A. Braun
*Assistant Examiner*—Willie Berry, Jr.
*Attorney, Agent, or Firm*—Charles E. Baxley

[57] ABSTRACT

A dispenser for storage and dispensing of merchandise which is packaged in containers which are mounted on cards includes a support member and a plurality of clip assemblies which are removably mounted on the support member. The clip assemblies each include a slot and a spring-loaded ball which projects into the slot and which bears on an indentation formed in a wall of the slot. The spring-loaded ball passes through a hole in the card and retains the card in a secure manner until the card is pulled free by a purchaser.

15 Claims, 3 Drawing Sheets

FIG. 3
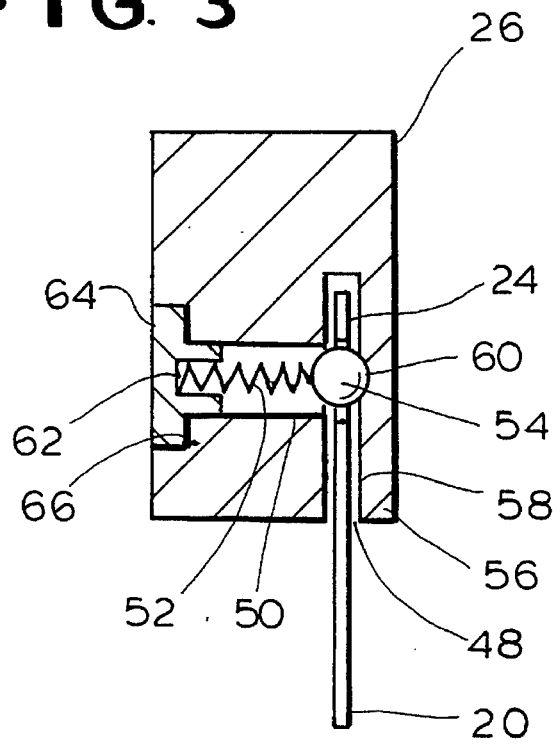
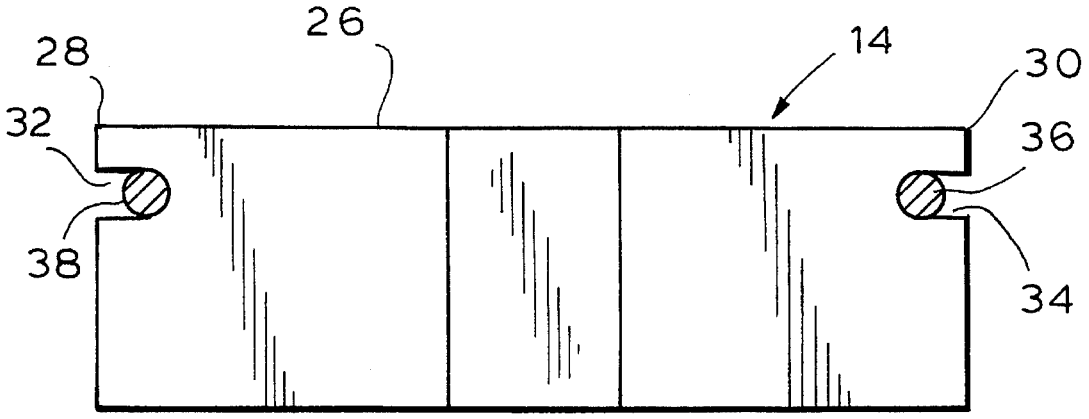
FIG. 4

POINT OF PURCHASE DISPENSER

BACKGROUND OF THE INVENTION

The present invention relates generally to apparatus for storage and display of retail merchandise and, more particularly, to a point of purchase dispenser for carded merchandise.

The prior art related to apparatus for the storage and display of retail merchandise typically includes a plurality of support members in the form of individual rods which are mounted in either a fixed or adjustable relationship projecting from vertical walls of a display area. Carded merchandise is typically stored in transparent vacuum formed containers which are mounted on a lower portion of a card. A die-cut hole is formed in an upper portion of the card and the support rod passes through the hole to hold a plurality of the cards.

Disadvantages of the apparatuses of the prior art include unattractive appearance and potential dangers associated with exposed ends of projecting rods which are necessarily relatively small in diameter in order to pass through the die-cut holes. In addition, the action of inserting carded merchandise onto the rods and removing the merchandise from the rods tends to tear the cards and thus renders the merchandise unattractive and unsuitable for resale in the event that the merchandise is returned for a refund.

OBJECTS AND SUMMARY OF THE INVENTION

It is an object of the present invention to provide a point of purchase dispenser for carded merchandise which allows repeated insertion and removal of carded merchandise without damage to the merchandise.

Another object of the present invention is to provide a point of purchase dispenser which is capable of holding carded merchandise in a secure manner.

Another object of the present invention is to provide a point of purchase dispenser which allows rapid installation of merchandise, thus lowering operating costs.

Another object of the present invention is to provide a point of purchase dispenser which provides a safe projecting surface.

Yet another object of the present invention is to provide a point of purchase dispenser which comprises a relatively small number of component parts that can be manufactured in volume at a relatively low unit cost.

The foregoing and other objects and advantages of the present invention will appear more fully hereinafter.

In accordance with the present invention, there is provided a point of purchase dispenser for the storage and dispensing of merchandise which is packaged in containers which are mounted on cards with the point of purchase dispensers including a support member and a plurality of clip assemblies.

The support member includes a pair of parallel rods. The clip assemblies each include a pair of oppositely directed slots which removably engage the parallel rods and allow the clip assembly to slide along the support member. Each of the clip assemblies also include a slot portion which is proportioned to accept the upper portion of the merchandise card and a spring-loaded ball which projects into the slot and bears on an indentation formed in the front wall of the slot. The spring-loaded ball projects through a die-cut hole which is formed in the upper portion of the merchandise card and holds the card securely until the card is pulled downward by a purchaser allowing the ball to roll out of the die-cut hole and roll along the top of the card, thereby releasing the card from the dispenser.

In an alternative embodiment of the present invention, the clip assemblies each have an aperture and the support member has a single rod which passes through the aperture to support the clip assemblies.

BRIEF DESCRIPTION OF THE DRAWINGS

Other important objects and advantages of the present invention will be apparent from the following detailed description taken in conjunction with the accompanying drawings in which:

FIG. 3 is a fragmentary cross-sectional view taken along line 3—3 of FIG. 1;

FIG. 4 is a view taken along line 4—4 of FIG. 1;

DETAILED DESCRIPTION OF THE INVENTION

Figure 1:
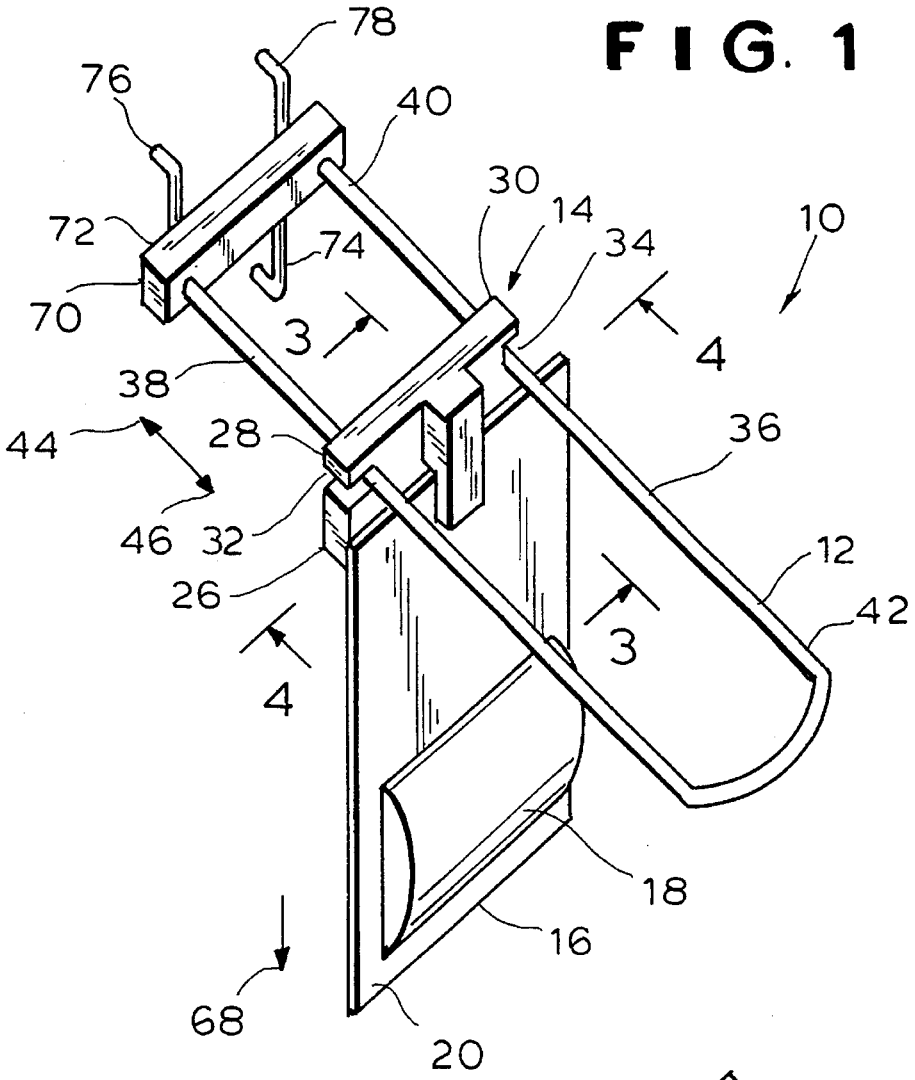
FIG. 1 is an overall perspective view of a point of purchase dispenser made according to the present invention.
Figure 2:
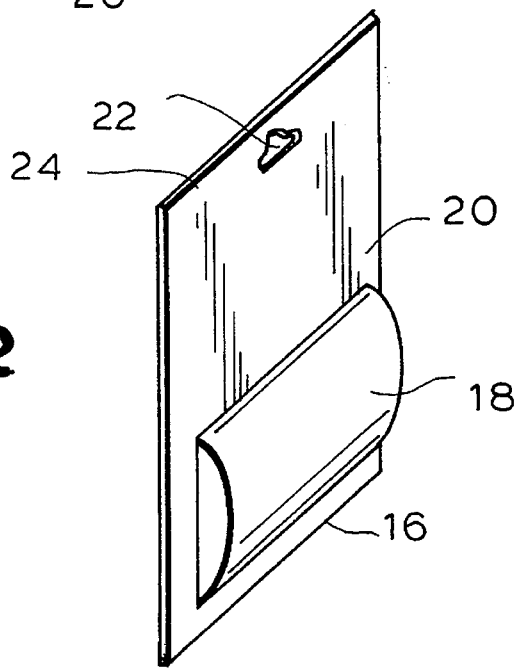
FIG. 2 is a perspective view of a conventional merchandise card, with merchandise stored in a plastic container, for use with the point of purchase dispenser of FIG. 1.

With reference to the drawings, there is shown in FIG. 1 a point of purchase dispenser 10 according to the present invention, which incorporates a support member 12 and a plurality of identical clip assemblies 14, only one of which is shown. The dispenser 10 is used to store a plurality of conventional carded merchandise 16. As is shown in FIG. 2, carded merchandise 16 includes a plastic container which is mounted on a card 20. A die-cut hole 22 is formed in an upper portion 24 of the card 20 and the hole 22 cooperates with the dispenser 10 in a manner which will be described presently.

The clip assembly 14 includes an elongated body portion 26, ends 28, 30 of which each include an aperture 32, 34. Apertures 32, 34 engage rod portions 36, 38 of the support member 12 as is shown in FIGS. 1 and 4 and are proportioned to allow the clip assembly 14 to slide along the support member 12 from a rear 40 of the support member 12 to a front 42 in the directions shown by arrows 44, 46 in FIG. 1.

The body portion 26 includes a slotted aperture 48 which is proportioned so as to allow insertion of the upper portion 24 of the card 20.

A spring cavity 50 is formed in the body portion 26 with a spring cavity 50, communicating with the slotted aperture 48. A helical compression spring 52 and a spherical bearing ball 54 are positioned in the spring cavity 50 as is shown in FIG. 3. The body portion 26 and the helical spring 52 are proportioned so that the ball 54 is always forced to bear on a front portion 56 of the body portion 26. A surface 58 of the aperture includes a spherical indentation 60 which allows the ball 54 to lodge securely in the front portion 56. An end 62 of the spring 52 is retained by a spring seat 64 which may be attached to the body portion 26 by an adhesive layer 66.

The spherical ball 54 allows the upper portion 24 of the card 16 holding the merchandise to be easily inserted into the slot 48. As the card 20 is inserted into the slot 48, the spherical ball 54 compresses the helical spring 52 and the smooth surface of the ball 54 allows the upper portion 24 to be pushed past the ball 54 without damage to the card 20. As the card 20 is inserted into the slot 48, the ball 54 protrudes through the die-cut hole 22 in the card 20 and lodges in the spherical indentation 60, thereby holding the merchandise card 16 in a secure manner.

When a customer wishes to purchase the carded merchandise 16, he/she simply pulls the card 24 downward in the direction shown by an arrow 68 in FIG. 1, thereby pulling the upper portion 22 of the card 20 past the spring-loaded ball 54. The smooth surface of the ball 54 and the helical spring 52 which is compressed as the card 20 is pulled downward allow card 20 to be withdrawn easily without damage to card 20.

The support member 12 includes two parallel support rod portions 36, 38 and a peg-board attachment member 70. The peg-board attachment member 70 includes a transverse member 72 from which three tong portions 74, 76, 78 project, as is shown in FIG. 1. Tong portions 74, 76, 78 are proportioned for insertion into a conventional peg-board wall or similar wall having a plurality of apertures, thereby facilitating ease of installation and repositioning of a plurality of support members 12 on a wall to display and dispense merchandise of various sizes.

The support rod portions 36, 38 may be formed of steel rod, having a preferred diameter in the order of 3/16 inch and the steel rod may be finished using a conventional chrome plate, galvanization or anodization process. Transverse member 72 may be attached to the rod portions 36, 38 using a conventional welding or spot welding process.

The clip assemblies 14 may be made of acrylonitride-butadiene-styrene (ABS) plastic or a similar material.

Figure 5:
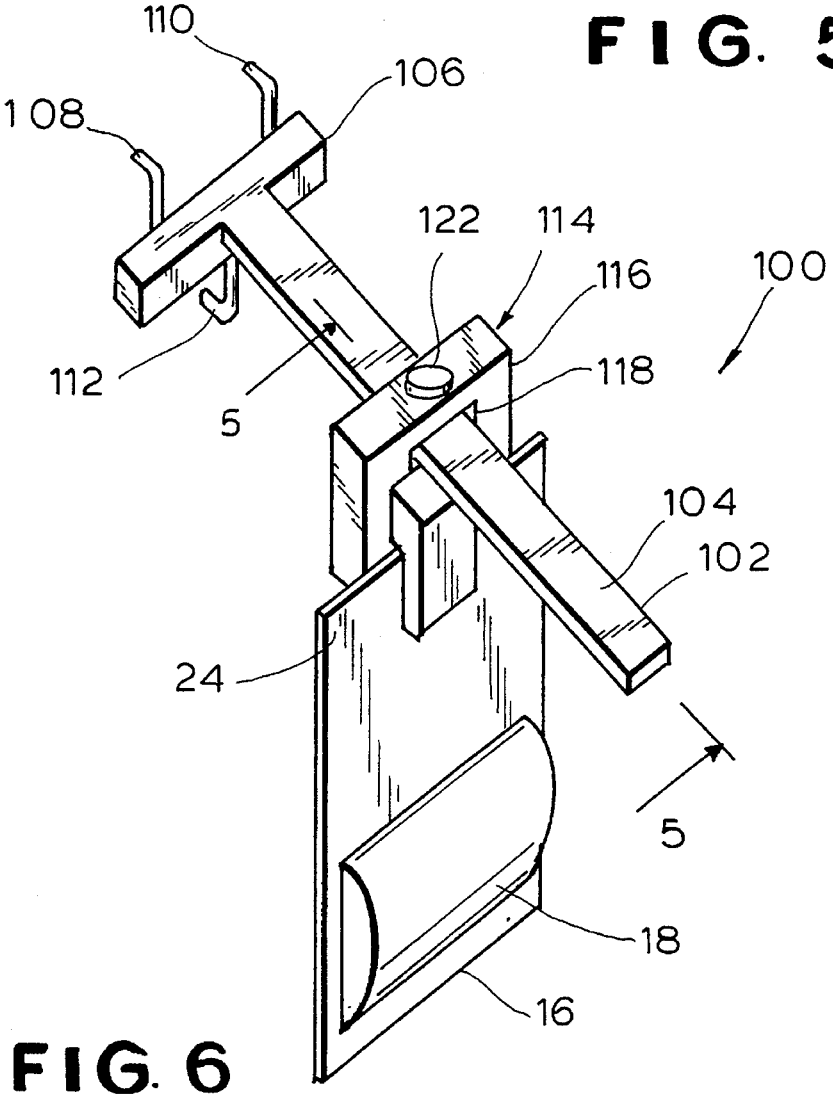
FIG. 5 is an overall perspective view of an alternative embodiment of the invention of FIG. 1, incorporating a single support rod.
Figure 6:
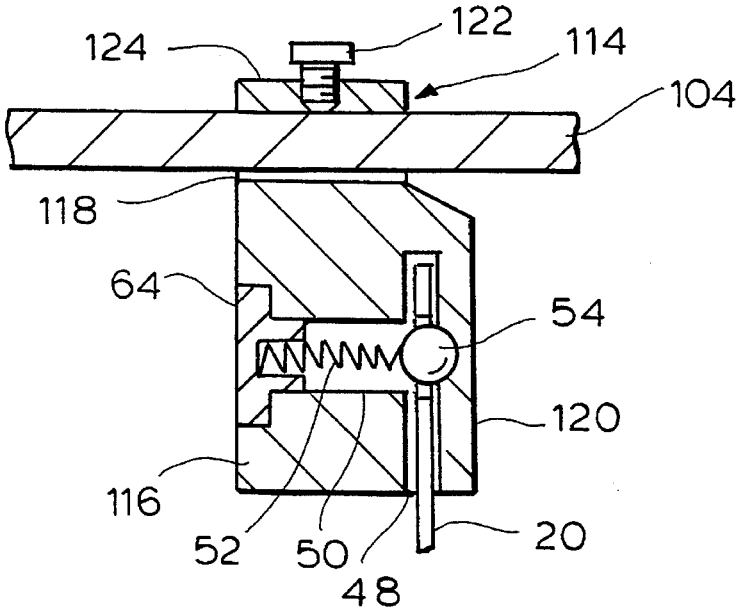
FIG. 6 is a fragmentary cross-sectional view taken along line 6—6 of FIG. 5.

In an alternative embodiment of the invention 100, which is shown in FIGS. 5 and 6, the support member 12 is replaced by a support member 102 which includes a single rod 104 which may be made of metal or plastic. The rod 104 may be round, square or rectangular in cross-section. The rod 104 projects from a base portion 106 which includes three tong portions 108, 110, 112 for removably mounting the base portion 106 on a standard peg-board wall as has been previously described.

A plurality of identical clip assemblies 114 are provided, each of which includes a body portion 116 which has an aperture 118 which allows a clip assembly 114 to slide onto the support rod 104. As has been previously described in connection with FIGS. 1–3, the clip assembly 114 includes a helical spring 52 which is mounted in a cavity 50 and which bears on a ball bearing 54, thereby urging the ball bearing 54 into contact with the front portion 120 of the clip assembly 114. The spring loaded ball 54 allows the easy insertion of the merchandise card 20 into the slot 40 and the easy removal of the card 20 by a purchaser.

The clip assembly 114 may include a clamp screw 122 which is mounted on top 124 of body portion 116. The clamp screw 122 can be used to clamp the body portion 116 to the rod 104 to prevent sliding once the desired position of the clip assembly 114 has been reached.

The foregoing specific embodiments of the present invention, as set forth in the specification herein, are for illustrative purposes only. Various changes and modifications may be made within the spirit and scope of the invention.

I claim:

1. A point of purchase dispenser comprising:

support means having a first end and a second end, first attachment means disposed on said first end of said support means, a clip assembly, second attachment means disposed on said clip assembly for removable attachment of said clip assembly to said support means, a first portion formed on said clip assembly, a second portion formed on said clip assembly, with said first and second portions spaced apart, thereby defining a slot between said first and said second portions, ball means mounted on said second portion, and resilient means mounted on said second portion, between said second portion and said ball means, with said resilient means urging said ball means to project through said slot and bear against said first portion.

2. A point of purchase dispenser according to claim 1, in which said ball means comprises a spherical ball.

3. A point of purchase dispenser according to claim 1, in which said resilient means comprises a helical compression spring.

4. A point of purchase dispenser according to claim 3, further comprising a cavity portion formed in said second portion of said clip assembly with said resilient means mounted in said cavity portion.

5. A point of purchase dispenser according to claim 1, further comprising an indentation portion formed in said first portion of said clip assembly with said ball means projecting into said indentation portion.

6. A point of purchase dispenser according to claim 1, in which said first attachment means comprises a plurality of tong members.

7. A point of purchase dispenser according to claim 1, in which said second attachment means comprises slot means on said body member for removably engaging said support means.

8. A point of purchase dispenser according to claim 1, in which said second attachment means comprises aperture means formed in said clip assembly with said support means projecting through said aperture means.

9. A point of purchase dispenser according to claim 8, in which said support means comprises a rod member.

10. A point of purchase dispenser according to claim 8, further comprising clamp means mounted on said clip assembly for clamping said clip assembly to said support means.

11. A point of purchase dispenser according to claim 10, in which said clamp means comprises a clamp screw.

12. A point of purchase dispenser according to claim 1, in which said support means comprises a pair of parallel rods.

13. A point of purchase dispenser according to claim 12, in which said second attachment means comprises a pair of oppositely directed slot portions formed on said clip assembly with said parallel rods removably engaged, one each in said slot portions.

14. A point of purchase dispenser according to claim 1, in which said support means comprises a continuous rod having a first straight portion, a second curved portion and a third straight portion, with said third straight portion disposed parallel to said first straight portion.

15. A point of purchase dispenser according to claim 1, further comprising a transverse member mounted on said first end of said support means.

* * * * *